US009231380B2

(12) United States Patent
Ma

(10) Patent No.: US 9,231,380 B2
(45) Date of Patent: Jan. 5, 2016

(54) ELECTRODE MATERIAL FOR A SPARK PLUG

(71) Applicant: FEDERAL-MOGUL IGNITION COMPANY, Southfield, MI (US)

(72) Inventor: Shuwei Ma, Ann Arbor, MI (US)

(73) Assignee: Federal-Mogul Ignition Company, Southfield, MI (US)

( * ) Notice: Subject to any disclaimer, the term of this patent is extended or adjusted under 35 U.S.C. 154(b) by 59 days.

(21) Appl. No.: 13/943,423

(22) Filed: Jul. 16, 2013

(65) Prior Publication Data

US 2014/0015399 A1 Jan. 16, 2014

Related U.S. Application Data

(60) Provisional application No. 61/671,861, filed on Jul. 16, 2012.

(51) Int. Cl.
*H01T 13/39* (2006.01)

(52) U.S. Cl.
CPC ..... *H01T 13/39* (2013.01)

(58) Field of Classification Search
CPC ..... H01T 13/39
USPC ..... 313/141
See application file for complete search history.

(56) References Cited

U.S. PATENT DOCUMENTS

| | | | | |
|---|---|---|---|---|
| 2,545,438 | A | 3/1951 | Stumbock et al. | |
| 4,324,588 | A | 4/1982 | Zysk et al. | |
| 4,659,960 | A | 4/1987 | Toya et al. | |
| 4,881,913 | A | 11/1989 | Mann | |
| 4,910,428 | A | 3/1990 | Strumbos | |
| 5,347,193 | A | 9/1994 | Oshima et al. | |
| 5,456,624 | A | 10/1995 | Moore et al. | |
| 5,461,275 | A | 10/1995 | Oshima | |
| 5,550,425 | A | 8/1996 | Yoder | |
| 5,796,019 | A | 8/1998 | Lupton et al. | |
| 5,990,602 | A | 11/1999 | Katoh et al. | |
| 6,094,000 | A | 7/2000 | Osamura et al. | |
| 6,262,522 | B1 | 7/2001 | Osamura et al. | |
| 6,412,465 | B1 * | 7/2002 | Lykowski et al. | 123/169 EL |
| 6,628,051 | B1 | 9/2003 | Menken et al. | |
| 7,385,339 | B2 | 6/2008 | Lineton et al. | |
| 2004/0140745 | A1 | 7/2004 | Hrastnik | |
| 2007/0057613 | A1 | 3/2007 | Brady et al. | |
| 2008/0302323 | A1 * | 12/2008 | Kern et al. | 123/145 A |
| 2010/0026159 | A1 | 2/2010 | Ohm et al. | |
| 2010/0052497 | A1 | 3/2010 | Walker, Jr. et al. | |
| 2010/0276646 | A1 * | 11/2010 | Manhardt et al. | 252/514 |
| 2011/0198983 | A1 * | 8/2011 | Manhardt et al. | 313/252 |

FOREIGN PATENT DOCUMENTS

| | | | |
|---|---|---|---|
| JP | 61135083 | * | 6/1986 |

* cited by examiner

*Primary Examiner* — Nimeshkumar Patel
*Assistant Examiner* — Jacob R Stern
(74) *Attorney, Agent, or Firm* — Reising Ethington, P.C.

(57) ABSTRACT

An electrode material for use with spark plugs and other ignition devices. The electrode material is a two-phase composite material that includes a matrix component and a dispersed component embedded in the matrix component. In a preferred embodiment, the matrix component is a precious-metal based material and the dispersed component includes a material that exhibits a high melting point and a low work function such as, for example, carbides, nitrides, and/or intermetallics. A process for forming the electrode material into a spark plug electrode is also provided.

19 Claims, 7 Drawing Sheets

ELECTRODE MATERIAL FOR A SPARK PLUG

REFERENCE TO RELATED APPLICATIONS

This application claims the benefit of U.S. Provisional Ser. No. 61/671,861 filed on Jul. 16, 2012, the entire contents of which are incorporated herein.

TECHNICAL FIELD

This invention generally relates to spark plugs and other ignition devices for internal combustion engines and, in particular, to electrode materials for spark plugs.

BACKGROUND

Spark plugs can be used to initiate combustion in internal combustion engines. Spark plugs typically ignite a gas, such as an air/fuel mixture, in an engine cylinder or combustion chamber by producing a spark across a spark gap defined between two or more electrodes. Ignition of the gas by the spark causes a combustion reaction in the engine cylinder that is responsible for the power stroke of the engine. The high temperatures, high electrical voltages, rapid repetition of combustion reactions, and the presence of corrosive materials in the combustion gases can create a harsh environment in which the spark plug must function. This harsh environment can contribute to erosion and corrosion of the electrodes that can negatively affect the performance of the spark plug over time, potentially leading to a misfire or some other undesirable condition.

To reduce erosion and corrosion of the spark plug electrodes, various types of precious metals and their alloys—such as those made from platinum and iridium—have been used. These materials, however, can be costly. Thus, spark plug manufacturers sometimes attempt to minimize the amount of precious metals used with an electrode by using such materials only at a firing tip or spark portion of the electrodes where a spark jumps across a spark gap.

SUMMARY

According to one aspect, there is provided a spark plug, comprising: a metallic shell having an axial bore; an insulator having an axial bore and being at least partially disposed within the axial bore of the metallic shell; a center electrode being at least partially disposed within the axial bore of the insulator; and a ground electrode being attached to a free end of the metallic shell. The center electrode, the ground electrode or both includes an electrode material that has a multi-phase composite material with a matrix component and a dispersed component, wherein the matrix component includes at least one precious metal and the dispersed component is embedded in the matrix component and includes at least one item selected from the group consisting of: carbides, nitrides or intermetallics.

According to another aspect, there is provided an electrode material for a spark plug, the electrode material comprising: a multi-phase composite material that includes a matrix component and a dispersed component embedded in the matrix component. The matrix component is a precious-metal based alloy that includes a precious metal as the single largest constituent, and the dispersed component includes at least one of carbides, nitrides, or intermetallics.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

Figure 1:
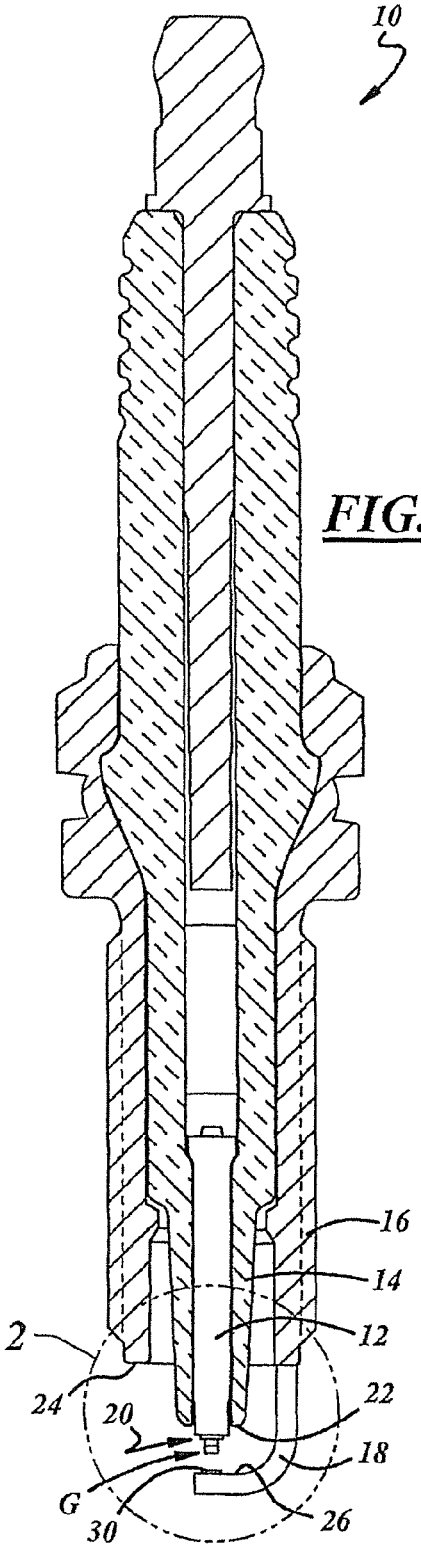
FIG. 1 is a cross-sectional view of an exemplary spark plug that may use the electrode material described below.

The electrode material described herein may be used in spark plugs and other ignition devices including industrial plugs, aviation igniters, glow plugs, or any other device that is used to ignite an air/fuel mixture in an engine. This includes, but is certainly not limited to, the exemplary spark plugs that are shown in the drawings and are described below. Furthermore, it should be appreciated that the electrode material may be used in a firing tip that is attached to a center and/or ground electrode or it may be used in the actual center and/or ground electrode itself, to cite several possibilities. Other embodiments and applications of the electrode material are also possible.

Figure 2:
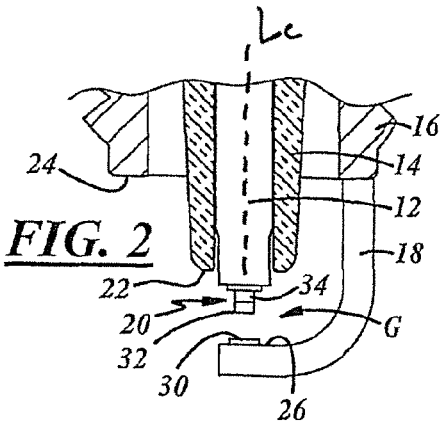
FIG. 2 is an enlarged view of the firing end of the exemplary spark plug from FIG. 1, wherein a center electrode has a firing tip in the form of a multi-piece rivet and a ground electrode has a firing tip in the form of a flat pad.

Referring to FIGS. 1 and 2, there is shown an exemplary spark plug 10 that includes a center electrode 12, an insulator 14, a metallic shell 16, and a ground electrode 18. The center electrode or base electrode member 12 is disposed within an axial bore of the insulator 14 and includes a firing tip 20 that protrudes beyond a free end 22 of the insulator 14. The firing tip 20 is a multi-piece rivet that includes a first component 32 made from an erosion- and/or corrosion-resistant material, like the electrode material described below, and a second component 34 made from an intermediary material like a high-chromium nickel alloy. In this particular embodiment, the first component 32 has a cylindrical shape and the second component 34 has a stepped shape that includes a diametrically-enlarged head section and a diametrically-reduced stem section. The first and second components may be attached to one another via a laser weld, a resistance weld, or some other suitable welded or non-welded joint. Insulator 14 is disposed within an axial bore of the metallic shell 16 and is constructed from a material, such as a ceramic material, that is sufficient to electrically insulate the center electrode 12 from the metallic shell 16. The free end 22 of the insulator 14 may protrude beyond a free end 24 of the metallic shell 16, as shown, or it may be retracted within the metallic shell 16. The ground electrode or base electrode member 18 may be constructed according to the conventional L-shape configuration shown in the drawings or according to some other arrangement, and is attached to the free end 24 of the metallic shell 16. According to this particular embodiment, the ground electrode 18 includes a side surface 26 that opposes the firing tip 20 of the center electrode and has a firing tip 30 attached thereto. The firing tip 30 is in the form of a flat pad and defines a spark gap G with the center electrode firing tip 20 such that they provide sparking surfaces for the emission and reception of electrons across the spark gap.

Figure 3:
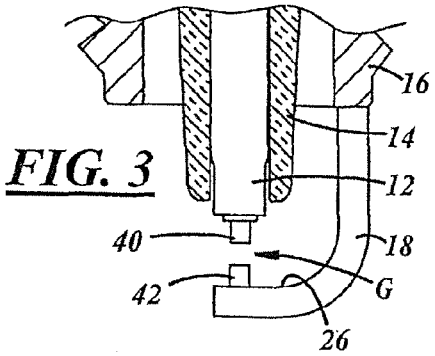
FIG. 3 is an enlarged view of a firing end of another exemplary spark plug that may use the electrode material described below, wherein the center electrode has a firing tip in the form of a single-piece rivet and the ground electrode has a firing tip in the form of a cylindrical tip.
Figure 4:
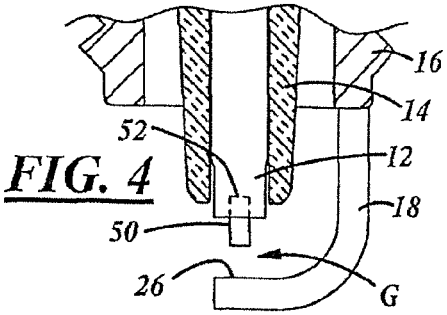
FIG. 4 is an enlarged view of a firing end of another exemplary spark plug that may use the electrode material described below, wherein the center electrode has a firing tip in the form of a cylindrical tip located in a recess and the ground electrode has no firing tip.
Figure 5:
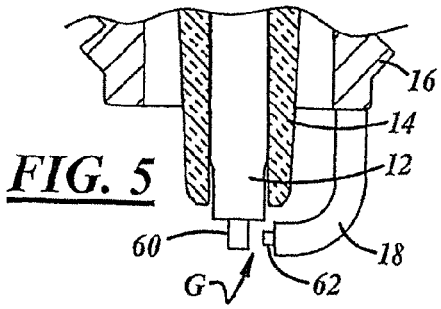
FIG. 5 is an enlarged view of a firing end of another exemplary spark plug that may use the electrode material described below, wherein the center electrode has a firing tip in the form of a cylindrical tip and the ground electrode has a firing tip in the form of a cylindrical tip that extends from an axial end of the ground electrode.

In this particular embodiment, the first component 32 of the center electrode firing tip 20 and/or the ground electrode firing tip 30 may be made from the electrode material described herein; however, these are not the only applications for the electrode material. For instance, as shown in FIG. 3, the exemplary center electrode firing tip 40 and/or the ground electrode firing tip 42 may also be made from the electrode material. In this case, the center electrode firing tip 40 is a single-piece rivet and the ground electrode firing tip 42 is a cylindrical tip that extends away from a side surface 26 of the ground electrode by a considerable distance. The electrode material may also be used to form the exemplary center electrode firing tip 50 and/or the ground electrode 18 that is shown in FIG. 4. In this example, the center electrode firing tip 50 is a cylindrical component that is located in a recess or blind hole 52, which is formed in the axial end of the center electrode 12. The spark gap G is formed between a sparking surface of the center electrode firing tip 50 and a side surface 26 of the ground electrode 18, which also acts as a sparking surface. FIG. 5 shows yet another possible application for the electrode material, where a cylindrical firing tip 60 is attached to an axial end of the center electrode 12 and a cylindrical firing tip 62 is attached to an axial end of the ground electrode 18. The ground electrode firing tip 62 forms a spark gap G with a side surface of the center electrode firing tip 60, and is thus a somewhat different firing end configuration than the other exemplary spark plugs shown in the drawings.

Again, it should be appreciated that the non-limiting spark plug embodiments described above are only examples of some of the potential uses for the electrode material, as it may be used or employed in any firing tip, electrode, spark surface or other firing end component that is used in the ignition of an air/fuel mixture in an engine. For instance, the following components may be formed from the electrode material: center and/or ground electrodes; center and/or ground electrode firing tips that are in the shape of rivets, cylinders, bars, columns, wires, balls, mounds, cones, flat pads, disks, rings, sleeves, etc.; center and/or ground electrode firing tips that are attached directly to an electrode or indirectly to an electrode via one or more intermediate, intervening or stress-releasing layers; center and/or ground electrode firing tips that are located within a recess of an electrode, embedded into a surface of an electrode, or are located on an outside of an electrode such as a sleeve or other annular component; or spark plugs having multiple ground electrodes, multiple spark gaps or semi-creeping type spark gaps. These are but a few examples of the possible applications of the electrode material, others exist as well. As used herein, the term "electrode"—whether pertaining to a center electrode, a ground electrode, a spark plug electrode, etc.—may include a base electrode member by itself, a firing tip by itself, or a combination of a base electrode member and one or more firing tips attached thereto, to cite several possibilities.

Figure 6:
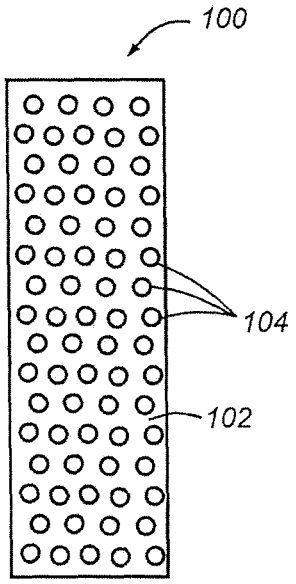
FIG. 6 is a cross-sectional view of an exemplary electrode material that is in the form of a composite material which includes a matrix component and a dispersed component.

The electrode material, with reference to the exemplary embodiment illustrated in FIG. 6, is a multi-phase composite material 100 that includes a matrix component 102 and a dispersed component 104 embedded within the matrix component 102. The composite material 100 is considered "multi-phase" because the matrix component 102 and the dispersed component 104 are not completely assimilated on a molecular level into a material deemed to be a single composition; rather the two components are separate materials that exhibit some sort of interface or transitional boundary therebetween. The composite material 100 may include anywhere from about 70 vol. % to about 99.9 vol. %—preferably about 98 vol. % to about 99.9 vol. %—of the matrix component 102 and anywhere from about 0.1 vol. % to about 30 vol. %—preferably about 0.1 vol % to about 2.0 vol. %—of the particulate component 104. Any particular distribution of the dispersed component 104 within the matrix component 102 may be employed. For example, the dispersed component 104 may be homogeneously dispersed throughout the matrix component 102. In another example, however, a non-homogenous dispersion profile may be employed in which the concentration of the dispersed component 104 in the matrix component 102 differs from one portion of the composite material 100 to another.

The matrix component 102—also referred to as a matrix phase or binder—is the portion of the composite material 100 into which the dispersed component 104 is embedded. The matrix component 102 is precious metal-based; that is, it includes a precious metal as the single largest constituent on a weight % basis. The designation "precious metal-based" includes, for instance, a material having greater than 50 wt % of a precious metal, as well as a material having less than 50 wt % of a precious metal so long as the precious metal is the single largest constituent on a weight % basis. The matrix component 102 may be a pure precious metal (about 100 wt % precious metal notwithstanding any unavoidable impurities) or an alloy (e.g., binary-, ternary- or quaternary-alloy) including one or more precious metals, or some other suitable precious metal-based material. Preferred precious metals that may be included in the precious-metal based matrix component 102 are platinum (Pt), Iridium (Ir), palladium (Pd), rhodium (Rh), and ruthenium (Ru). A periodic table published by the International Union of Pure and Applied Chemistry (IUPAC) is provided in Addendum A (hereafter the "attached periodic table") and is to be used with the present application.

Figure 7:
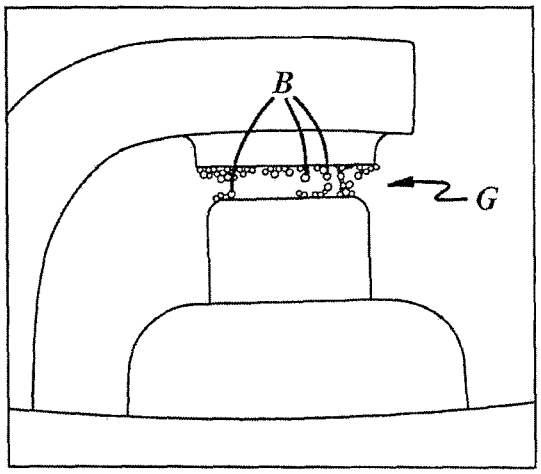
FIG. 7 is a schematic representation of a so-called balling and bridging phenomenon at the electrodes of an exemplary spark plug that does not use the electrode material described below.
Figure 8:
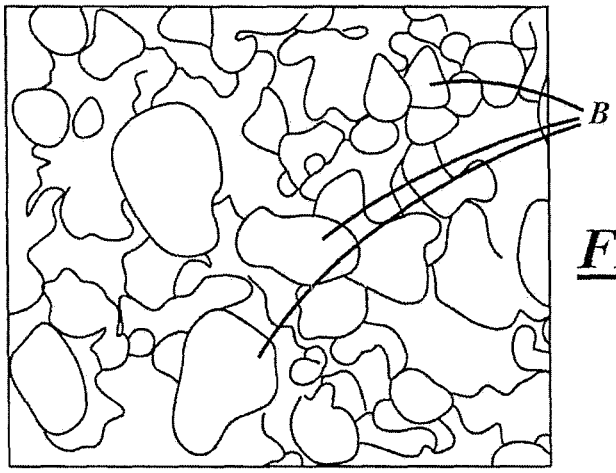
FIG. 8 is an enlarged schematic representation of the balling and bridging phenomenon of FIG. 7.
Figure 9:
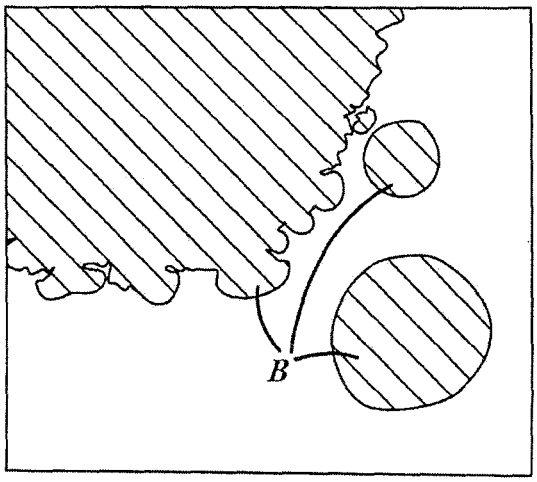
FIG. 9 is a cross-sectional schematic representation of the balling and bridging phenomenon of FIG. 7.

A precious metal-based material is used as the matrix component 102 because it generally possesses favorable oxidation, corrosion, and erosion resistance when used in ignition environments such as those found in internal combustion engines. But precious metal-based materials may be susceptible to undesirable metallurgical occurrences that can impact the performance of the spark plug in which it is used. Referring to FIGS. 7-9, for example, some precious metal-based alloys have a tendency to experience a so-called balling and bridging phenomenon in which localized melting and redeposition of material creates precious metal-based balls B at a surface thereof. This can occur during high temperature operations in an internal combustion engine, and, over time, the precious metal-based balls B can collect and form a bridge across the spark gap G. The ultimate result of balling and bridging is an enhanced rate of erosion (e.g., mass loss and wear) and corrosion of the spark plug electrodes that negatively affects the spark performance of the spark plug. Such balling and bridging can be mitigated or altogether prevented, it has been found, by the inclusion of the dispersed component 104 within the matrix component 102. Without wishing to be limited to a particular theory of operation, it is currently believed that, among other factors, the combined use of the matrix component 102 and the embedded dispersed component 104 provides the composite material 100 with a surface tension or surface energy that is sufficient to help counteract the balling and bridging phenomenon.

In addition to the precious metal(s), the matrix component 102 may also include other alloy constituents, if desired. One such additional alloy constituent is a refractory metal or a combination of refractory metals. These kinds of metals—which may be present from about 0.1 wt % to 10 wt. % of the matrix component 102—may provide the composite material 100 with any number of desirable attributes including a high melting temperature and a correspondingly high resistance to spark erosion, as well as improved ductility during manufacturing. Several suitable refractory metals that may be included in the precious metal-based matrix component 102 are rhenium (Re), tungsten (W), tantalum (Ta), molybdenum (Mo), niobium (Nb), or some combination of those metals. It is also possible for the precious metal-based matrix composite 102 to include one or more rare earth metals or active elements. These kinds of metals—which may be present from about 0.001 wt. % to about 0.3 wt. % of the matrix component 102—may provide the composite material 100 with, for instance, improved resistance to erosion and/or corrosion. Some rare earth metals that may be included in the matrix component 102 are yttrium (Y), hafnium (Hf), scandium (Sc), lanthanum (La), cerium (Ce), and/or other constituents. Besides the single largest precious metal constituent, the precious metal-based matrix component 102 does not necessarily have to include any or all of the types of metals just mentioned (e.g., the refractory metal(s) and the rare earth metal(s)); it may include only one of those types of metals, a combination of two or more of those types of metals, all of those types of metals, or none of those types of metals, as will be appreciated by a skilled artisan.

Figure 10:
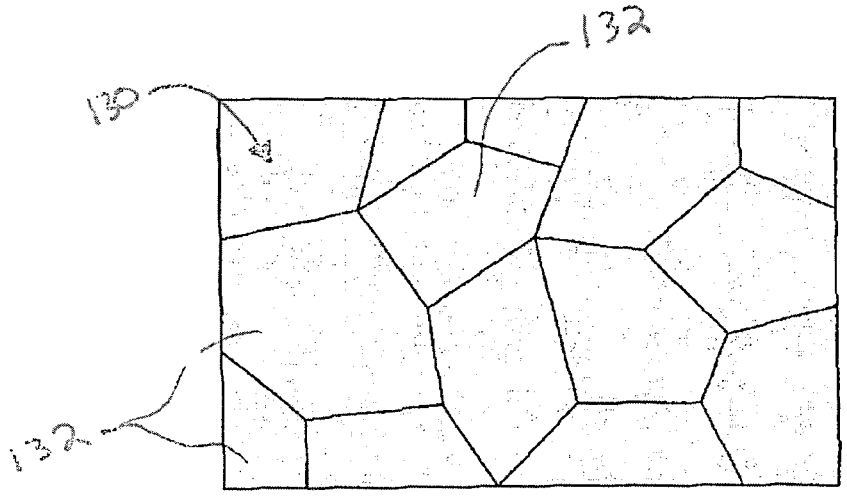
FIG. 10 is a generalized illustration of a precious-metal based matrix component (without the dispersed component) that has an equiaxed grain structure.
Figure 11:
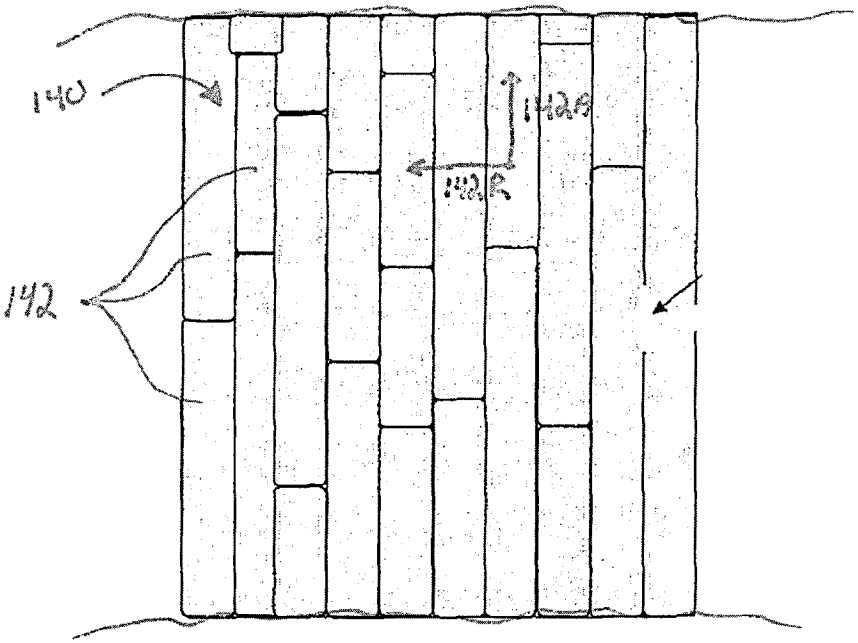
FIG. 11 is a generalized illustration of a precious-metal based matrix component (without the dispersed component) that has a "fibrous" grain structure which includes elongated grains.

The matrix component 102 may have an equiaxed grain structure, a fibrous grain structure, or some other desirable grain structure. An equiaxed grain structure 130, which is shown generally in FIG. 10 (without the dispersed component 104), includes grains 132 of generally consistent proportions. These grains 132 may have an average grain size that usually ranges from about 1 μm to about 100 μm—preferably less than 20 μm. A "fibrous" grain structure 140, on the other hand, which is shown in FIG. 11, comprises elongated grains 142 defined by an axial dimension 142A and a radial dimension 142R. The axial dimension 142A of the grains 142 is generally greater than the radial dimension 142R by a multiple of two or more, and, typically, six or more (e.g., 82A≥6× 82R). The elongated grains 142 are also oriented generally parallel to one another; that is, the axial dimensions 142A of the grains 142 are generally—but not necessarily exactly—aligned in parallel. Strict parallelism is not required for the elongated grains 142 to be considered generally parallel since it may be difficult, or impractical, to form all the grains 142 with consistent sizes in both the axial 142A and radial 142R dimensions, perfectly aligned end-to-end abutments, and perfectly smooth side-by-side interfaces, among others. Some leeway is tolerated so long as the elongated grains 142 as a group have their axial dimensions 142A extending in the same general direction. The terms "axial dimension" and "radial dimension" are used here to broadly denote the major dimensions of the elongated grains 142; they are not intended to suggest that the elongated grains 142 are necessarily restricted to being cylindrical in shape.

The dispersed component 104—also referred to as a dispersed phase or reinforcement—is the portion of the composite material 100 that is embedded in the matrix component 102. The dispersed component 104 comprises carbides, nitrides, intermetallics, or combinations thereof in the form of any suitable structure such as, for example, particles and/or elongated whiskers or fibers. The size of the particles, fibers, or other structures included in the dispersed component 104 can vary depending on several factors. For example, the particles, if present, may have an average particle size of about 20 μm or less, preferably about 10 μm or less, and the fibers, if present, may have an average diameter of about 20 μm or less, preferably about 10 μm or less, and an aspect ratio that ranges from about 5 to about 50. The elongated fibers, moreover, may be randomly oriented or aligned generally parallel to one another. Embodiments of the composite material 100 in which the matrix component 102 includes a "fibrous microstructure" 140 and the dispersed component 104 includes elongated fibers aligned generally parallel to each other and to the matrix component grains 142 are particularly preferred.

The types of materials chosen for the dispersed component 104 (e.g., carbides, nitrides, intermetallics) generally exhibit high melting points and/or low work functions which, as will be appreciated by skilled artisans, are properties that may be useful in contributing, along with the precious metal-based matrix component 102, to the operational durability of the composite material 100. Materials with high melting points, for instance, above about 1100° C., and preferably above about 1600° C., can help improve the spark erosion resistance of the composite material 100 on several fronts. Materials with work functions—an indication of how much energy is needed to extract an electron from the material—below about 6.0 eV, and preferably below about 5.0 eV, are useful keeping the voltage required to initiate sparking as low as possible. Work functions of this magnitude are generally consistent with, and sometimes lower than, the work functions associated with several different precious metals that may be included in the matrix component 102 (see Table 1 below). Materials that exhibit both a high melting point and a low work function can impart both attributes to the composite material 100.

TABLE 1

| Work functions of some precious metals | | | | | | |
|---|---|---|---|---|---|---|
| Precious Metal | Pt | Ir | Pd | Rh | Ru | Au |
| Work Function (eV) | 5.12-5.93 | 5.0-5.67 | 5.22-5.60 | 4.98 | 4.71 | 5.10-5.47 |

Several specific carbides that may be included in the dispersed component 104 are hafnium carbide (HfC), tungsten carbide (WC), zirconium carbide (ZrC), molybdenum carbide (MoC), chromium carbide ($Cr_3C_2$, $Cr_7C_3$, and $Cr_{23}C_6$), niobium carbide (NbC), tantalum carbide (TaC), vanadium carbide (VC), and titanium carbide (TiC), to name but a few examples. Each of these carbides has a high melting point, a high bond energy, a highly chemically inert surface, good electrical conductivity, and a low work function. The melting points and work functions of several of the more preferred carbides are detailed below in Table 2.

TABLE 2

| Properties of some select carbides | | | | | | |
|---|---|---|---|---|---|---|
| Particles | VC | $Cr_3C_2$ | NbC | HfC | TaC | WC |
| Work Function (eV) | 5.15 | 5.10-5.20 | 4.85-4.95 | 4.80-4.90 | 4.90 | 4.90 |
| Melting Point (° C.) | 2810 | 1895 | 3490 | 3305 | 3880 | 2870 |

Several specific nitrides that may be included in the dispersed component 104 are hafnium nitride (HfN), tungsten nitride (WN), zirconium nitride (ZrN), molybdenum nitride (MoN), chromium nitride (CrN), niobium nitride (NbN), tantalum nitride (TaN), vanadium nitride (VN), titanium nitride (TiN), titanium carbo-nitride (TiCN), titanium aluminum nitride (TiAlN), and titanium aluminum carbo-nitride (TiAlCN), to name but a few examples. And much like the carbides previously discussed, each of these nitrides has a high melting point, a high bond energy, a highly chemically inert surface, good electrical conductivity, and a low work function. The melting points and work functions of several of the more preferred nitrides are detailed below in Table 3.

TABLE 3

| Properties of some select nitrides | | | | | | |
|---|---|---|---|---|---|---|
| Particles | TiN | HfN | TaN | NbN | VN | TiAlN |
| Work Function (eV) | 5.05-5.15 | 4.70-4.80 | 4.70-4.80 | 4.95 | 5.05-5.15 | — |
| Melting Point (° C.) | 2930 | 3305 | 3090 | 2573 | 2050 | 2930 |

Several specific intermetallics that may be included in the dispersed component 104 are RuAl, NiAl, $Pt_3Al$, TiAl, $Fe_2Al_5$, $NbAl_3$, $MoSi_2$, RuTi, $NbPt_3$, to name but a few examples. These and other intermetallics are solid-state metallic phase materials in which the elemental metal constituents are present in stoichiometrically fixed proportions and generally defined crystal lattice locations. The melting points of several of the more preferred intermetallics are detailed below in Table 4.

TABLE 4

| Properties of some select intermetallics | | | | | | | | |
|---|---|---|---|---|---|---|---|---|
| Particles | RuAl | NiAl | Pt3Al | TiAl | Fe2Al5 | NbAl3 | MoSi2 | RuTi |
| Melting Point (° C.) | 2050 | 1638 | 1554 | 1500 | 1169 | 1680 | 2020 | 2130 |

The inclusion of dispersed component 104 in the matrix component 102 can have several effects on the properties of the composite material 100. For example, the addition of dispersed component 104 may increase the surface tension and/or the melting temperature of the composite material 100 in comparison to the same material without the dispersed component 104. The dispersed component 104—due to its relatively low work function—may also attract sparking away from the matrix component 102 so that localized temperatures of the matrix component 102 exposed at the sparking surface do not increase as quickly during sustained high-temperature spark plug operating events. Affecting the composite material 100 in this way enhances the corrosion and erosion resistance the composite material 100 when used in spark plug applications by, among other mechanisms, mitigating the balling and bridging phenomenon described above with reference to FIGS. 7-9. Furthermore, the dispersed component 104 generally reduces the overall cost of the composite material 100 because carbides, nitrides, and intermetallics typically cost less than the precious metals that are included in the matrix component 102.

The following embodiments recite different composite materials 100 materials from which any of the electrodes or electrode components shown in FIGS. 1-5, as well as others not specifically shown, may be constructed. These composite materials 100 are preferably used to construct the firing tip component 32 of the center electrode 12 and/or the firing tip 30 of the ground electrode 18, as depicted in FIG. 2, as well as the other center electrode firing tips 40, 50, 60 and ground electrode firing tips 42, 62 shown in FIGS. 3-5. These exemplary composite materials 100 are not meant to be an exhaustive list of all such embodiments, however, as others are certainly possible. It should be appreciated that any number of other constituents may be added to the following embodiments.

According to one embodiment, the matrix component 102 of the composite material 100 is platinum-based; that is, the single largest constituent of the matrix component 102 is platinum. The platinum-based matrix component 102 may, for example, be pure platinum (100 wt. % Pt notwithstanding unavoidable impurities) or a platinum alloy having nickel, tungsten, or iridium as the second largest constituent. Suitable platinum alloys that may be employed include (the following alloys are given in weight percentage, and the Pt constitutes the balance) Pt-(1-20)Ni, Pt-(1-10)Ni, Pt-(1-10)W, Pt-(1-5)W, Pt-(1-20)Ir, Pt-(1-10)Ir, Pt-(1-40)Pd, Pt-(1-30)Pd, Pt-(1-20)Pt, and Pt-(1-10)Pd. Some specific and preferred platinum alloys that may be used to construct the platinum-based matrix component 102 are Pt, Pt-10Ir, Pt-10Ni, and Pt-4W. Any of a wide variety of other platinum-based alloys may be used as well despite not being specifically mentioned here.

The dispersed component 104 embedded in the platinum-based matrix component 102 is preferably selected from the following lists of carbides, nitrides, and intermetallics: HfC, WC, ZrC, MoC, $Cr_{23}C_6$, $Cr_3C_2$, NbC, TaC, VC, TiC, HfN, WN, ZrN, MoN, CrN, NbN, TaN, VN, TiN, TiCN, TiAlN, TiAlCN, RuAl, NiAl, $Pt_3Al$, TiAl, $Fe_2Al_5$, $NbAl_3$, $MoSi_2$, RuTi, and $NbPt_3$. Some specific and preferred composite materials 100 that include a platinum metal-based material matrix 102 and a dispersed phased 104 that includes the materials listed above are (the following alloys are given in weight percentage, and the Pt constitutes the balance) Pt-(0.1-2.0)HfC, Pt-(0.1-2.0)WC, Pt-(0.1-2.0)NbC, Pt-(0.1-2.0)TaC, Pt-(0.1-2.0)HfN, Pt-(0.1-2.0)NbN, Pt-(0.1-2.0)TaN, Pt-(0.1-2.0)RuAl, Pt-(0.1-2.0)$MoSi_2$, and Pt-(0.1-2.0)RuTi.

It should be appreciated that the preceding embodiments represent only some of the possible combinations of the matrix component 102 and the dispersed component 104 that may be employed to form the composite material 100. For example, other precious metal-based materials may be used for the matrix component 102, and other carbides, nitrides, and/or intermetallics may be included in the dispersed component 104.

Figure 12:
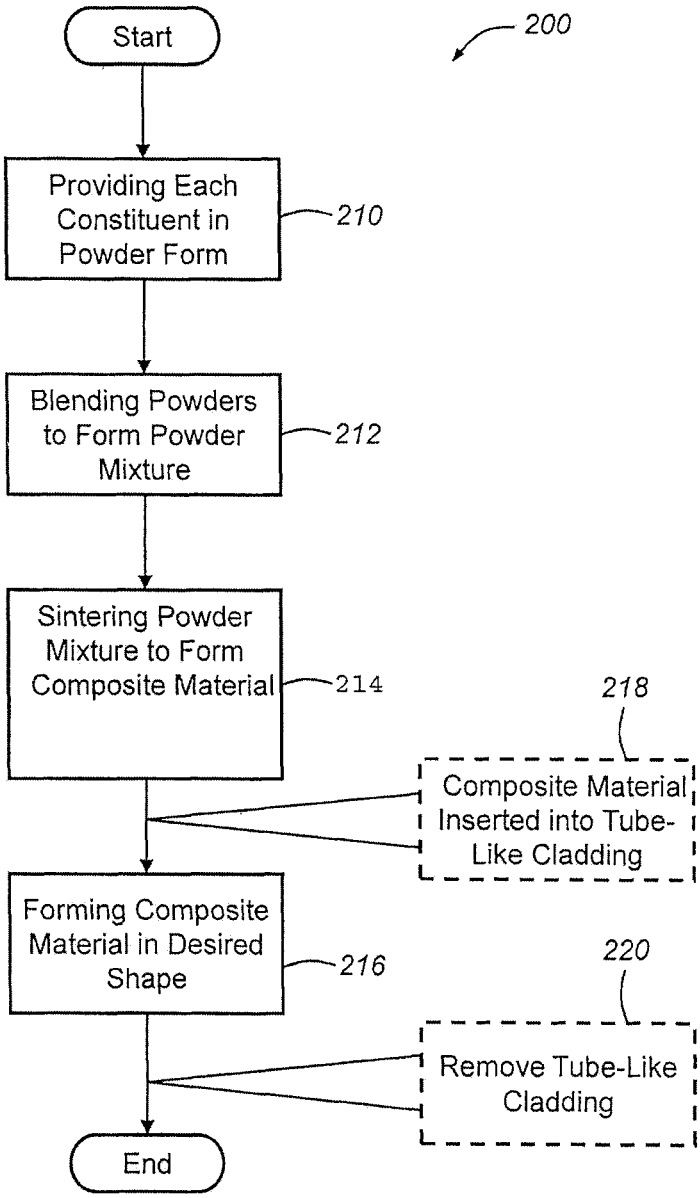
FIG. 12 is a flowchart illustrating an exemplary embodiment of a method for forming a spark plug electrode or electrode component.

Turning now to FIG. 12, the composite material 100 can be made and formed into an appropriate shape using a variety of manufacturing processes. For instance, a powder metallurgy process 200 may be used that includes the steps of: providing each of the constituents in powder form, step 210; blending the powders together to form a powder mixture, step 212; sintering the powder mixture to form the composite material 100, step 214; and forming the composite material 100 into a desired shape, step 216. The process may further include one or more optional steps that provide a cladding or sheath around the composite material 100 to make it more workable.

In step 210, the different constituents of the precious metal-based matrix component 102 and the dispersed component 104 are provided in powder form at appropriate powder or particle sizes that may be dependent on a number of factors. According to one exemplary embodiment, the constituents of the matrix component 102 and the dispersed component 104 are individually provided in powder form with each of the constituents having a particle size ranging from about 0.1 μm to about 200 μm or a diameter and aspect ratio ranging from about 0.2 μm to about 25 μm and about 0.5 to about 20, respectively. The sizes of the dispersed component 104 constituents may, in some instances, be larger than the expected sizes of the particles of fibers that constitute the dispersed component 104 to account for particle size reductions or elongation (fibers) that may occur during the forming step 216. In another embodiment, the constituents of the matrix component 102 are pre-alloyed and formed into a base matrix powder before being mixed with the constituents of the dispersed component 104.

Next, in step 212, the powders are blended together to form a powder mixture. In one embodiment, for example, the powder mixture includes enough of the matrix component 102 constituents and enough of the dispersed component 104 constituents so that the resultant composite material 100 comprises, depending on the particular composition of the composite material 100 desired, anywhere from about 70 vol. % to about 99.9 vol % of the matrix component 102 and anywhere from about 0.1 vol. % to about 30 vol. % of the particulate component 104. This mixing step may be performed with or without the addition of heat.

The sintering step 214 transforms the powder mixture into the composite material 100 through the application of heat. The sintering step 214 may be performed according to a number of different metallurgical embodiments. For instance, the powder mixture may be sintered in a vacuum, in a reduction atmosphere such as in a hydrogen-contained environment, or in some type of protected environment for up to several hours at an appropriate sintering temperature. Oftentimes an appropriate sintering temperature lies somewhere in the range of about 1200° C. to about 1700° C. for the precious metal-based powder constituents which form the matrix component 102. It is also possible for the sintering step 214 to apply pressure in order to introduce some type of porosity control. The amount of pressure applied may depend on the precise composition of the powder mixture and the desired attributes of the composite material 100. The composite material 100 that results following the sintering step 214 is preferably shaped as a bar or other.

Next, in step 216, the composite material 100 is formed into a desired shape by any known process or combination of processes such as, for example, rolling swaging, drawing, extrusion, annealing, or any other suitable technique. If an elongated wire is ultimately desired, then the composite material 100 bar derived from the sintering step 214 may be hot-swaged followed by repeated hot-drawing and intermittent annealing until an elongated fine wire of about 0.3 mm to about 1.5 mm in diameter is obtained. Repeated hot-drawing and intermittent annealing of the composite material 100 below its recrystallization temperatures may be practiced, for example, if the "fibrous" grain structure 140 described in FIG. 11 is desired. The elongated fine wire may then be cut or otherwise cross-sectioned into individual electrode tips or the like. Of course, other metal forming techniques could be used with step 216 to form the composite material 100 into parts having different shapes. For example, the composite material 100 could be forged, cast, or otherwise formed into ingots, bars, rivets, tips, etc.

Figure 15:
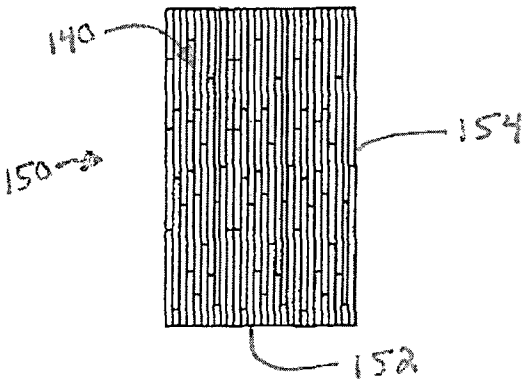
FIG. 15 is a generalized illustration of an electrode part in which the composite material has the "fibrous" grain structure illustrated in FIG. 11.

With brief reference to FIG. 15 for the moment, if the composite material 100 includes a "fibrous" grain structure 140, then a useable part 150 derived from the composite material elongated wire or other structure is preferably employed in any of the spark plugs shown in FIGS. 1-5 so that a surface 152 of the part 150 normal to the axial dimensions 142A of the grains 142 (hereafter "normal surface 152" for brevity) constitutes the sparking surface. Such an orientation of the part 150 within the spark plug 10 may result in the axial dimensions 142A of the elongated grains 142 (and the fibers in the dispersed component 104 if present) lying parallel to a longitudinal axis $L_C$ of the center electrode 12 (FIG. 2) if the part 150 is attached to the center electrode 12 or the ground electrode 18. For example, if the part 150 is used as the firing tip 32 for the multi-layer rivet (MLR) design shown in FIGS. 1-2, the normal surface 152 preferably faces the firing tip 30 attached to the ground electrode 18. In doing so, the axial dimensions 142A of the grains 142 lie parallel to the longitudinal axis $L_C$ of the center electrode 12 and perpendicular to the sparking surface of the firing tip 32. The part 150 is also preferably used in the same way for the other firing tip components 40, 50, shown in FIGS. 3-4. Likewise, as another example, if the part 150 is used as a firing tip 30, 42 attached to the ground electrode 18 in the designs shown in FIGS. 1-3, the normal surface 152 preferably faces the firing tip 32, 40 attached to the center electrode 12. In these embodiments, the axial dimensions 142A of the grains 142 lie parallel to the longitudinal axis $L_C$ of the center electrode 12, as before, and perpendicular to the sparking surface of the firing tip 32. Using another surface of the part 150—besides the normal surface 152—as the sparking surface, although not as preferred, may still be practiced. For example, if the part 105 is used as the firing tip 60 for the design shown in FIG. 5, the normal surface 152 may not face the firing tip 62 attached to the ground electrode 18; instead, a side surface 154 may face the firing tip 62 and act as the sparking surface.

Figure 13:
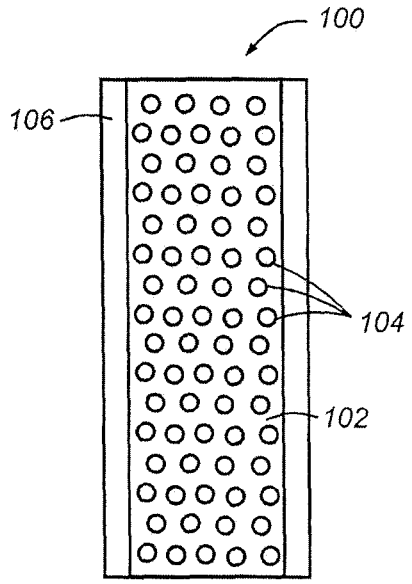
FIG. 13 is a cross-sectional view of the exemplary electrode material of FIG. 6 in which the electrode material further includes a cladding structure.

As mentioned above, it is also possible for method 200 to include an optional step in which the composite material 100 is formed with a cladding or sheath made of a different material, so that the combined electrode material and cladding can be formed during step 216. In one embodiment, an additional step 218 is provided where the already sintered composite material 100 from step 214 is inserted into a tube-like cladding structure 106, as illustrated in FIG. 13. The cladding structure 106 may be precious metal-based, nickel-based, copper-based, or zinc-based, for example. In the event that cladding structure 106 is precious metal-based, the cladding or sheathing may include pure platinum (Pt), pure palladium (Pd), pure gold (Au), pure silver (Ag) or some alloy thereof. In the example of a copper-based cladding structure, oxygen-free copper (Cu) is an acceptable choice. Zinc-based cladding structures may be used when a relatively high degree of lubrication is desired during the forming process. Other cladding materials are also possible, of course, even though not explicitly recited here. A cladding structure 106 having a cladding wall thickness of about 150 μm to about 3 mm may be used.

Figure 14:
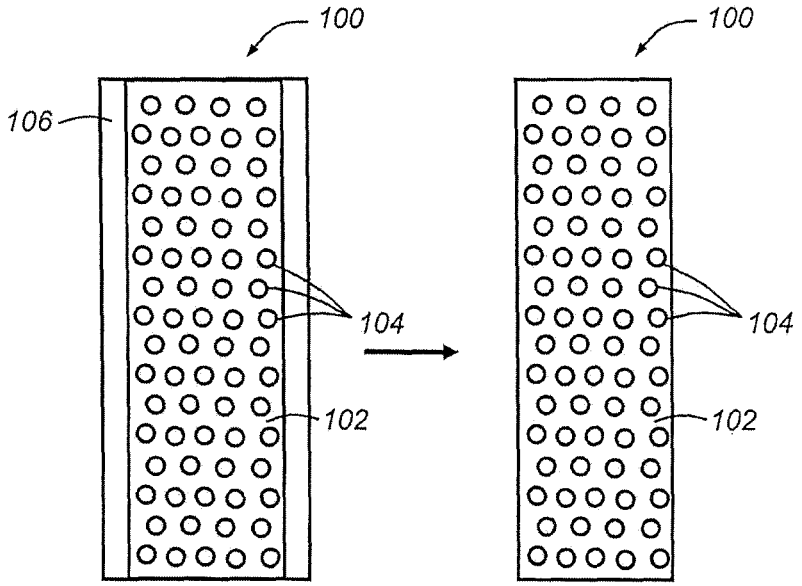
FIG. 14 is a cross-sectional view of the exemplary electrode material of FIG. 13 in which the cladding structure is subsequently removed via a chemical etching or other process.

In the exemplary cladding examples described above, once the composite material 100 and cladding structure 106 have been co-formed, the cladding structure 106 may be removed by chemical etching, mechanical measures, or some other suitable technique in optional step 220. This process is illustrated in FIG. 14. In these examples, the cladding structure 106 is used to facilitate the forming process, step 216, but is removed thereafter so that the resulting composite material 100 can be formed into a spark plug electrode or electrode component without any cladding.

The above-described processes may be used to form the composite material 100 into various shapes (such as rods, wires, sheets, etc.) that are suitable for further spark plug electrode and/or firing tip manufacturing processes. Other known techniques such as melting and blending the desired amounts of each constituent may be used in addition to or in lieu of those steps mentioned above. The composite material 100 can be further processed using conventional cutting and grinding techniques that are sometimes difficult to use with other known erosion-resistant electrode materials.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

The invention claimed is:

1. A spark plug, comprising: a metallic shell having an axial bore; an insulator having an axial bore and being at least partially disposed within the axial bore of the metallic shell; a center electrode being at least partially disposed within the axial bore of the insulator; and a ground electrode being attached to a free end of the metallic shell; the center electrode, the ground electrode or both includes an electrode material that has a multi-phase composite material with a matrix component and a dispersed component, wherein the matrix component includes at least one precious metal, a transition metal, and a rare earth metal, and the dispersed component is an intermetallic embedded in the matrix component, and wherein the matrix component includes about 0.001 wt % to 0.3 wt % of the rare earth metal.

2. The spark plug of claim 1, wherein the matrix component includes about 90 wt % to 99.9 wt % of the at least one precious metal.

3. The spark plug of claim 1, wherein the matrix component includes at least one precious metal selected from the group consisting of: platinum (Pt), Iridium (Ir), palladium (Pd), rhodium (Rh) or ruthenium (Ru).

4. The spark plug of claim 3, wherein the matrix is a platinum-based alloy and is selected from the group consisting of: Pt—Ni, Pt—W, Pt—Ir or Pt—Pd.

5. The spark plug of claim 1, wherein the matrix component includes about 0.1 wt % to 10 wt % of the transition metal.

6. The spark plug of claim 1, wherein the matrix component includes at least one transition metal selected from the group consisting of: rhenium (Re), tungsten (W), tantalum (Ta), molybdenum (Mo) or niobium (Nb).

7. The spark plug of claim 1, wherein the multi-phase composite material includes about 70 vol % to about 99.9 vol % of the matrix component and about 0.1 vol % to about 30 vol % of the dispersed component.

8. The spark plug of claim 1, wherein the matrix component includes at least one rare earth metal selected from the group consisting of: yttrium (Y), hafnium (Hf), scandium (Sc), lanthanum (La) or cerium (Ce).

9. The spark plug of claim 1, wherein the dispersed component includes at least one intermetallic selected from the group consisting of: ruthenium aluminum (RuA1), nickel aluminum (NiAl), platinum aluminum ($Pt_3Al$), titanium aluminum (TiAl), iron aluminum ($Fe_2Al_5$), niobium aluminum ($NbAl_3$), molybdenum silicon ($MoSi_2$), ruthenium titanium (RuTi) or niobium platinum ($NbPt_3$).

10. The spark plug of claim 1, wherein the dispersed component has a melting point above about 1100° C. and a work function below about 6.0 eV.

11. The spark plug of claim 1, wherein the dispersed component has a fibrous microstructure with elongated fibers or whiskers that are generally aligned parallel to each other and to grains of the precious metal-based matrix component and have an average diameter of about 20 μm or less.

12. The spark plug of claim 1, wherein the multi-phase composite material includes at least one of the following matrix component-dispersed component combinations, where the materials are given in weight percentage ranges and Pt constitutes the balance: Pt-(0.1-2.0)RuAl, Pt-(0.1-2.0) $MoSi_2$ or Pt-(0.1-2.0)RuTi.

13. The spark plug of claim 1, wherein the center electrode, the ground electrode or both includes a separate firing tip that is made from the multi-phase composite material and is attached to the center electrode, the ground electrode or both via welding.

14. An electrode material for a spark plug, the electrode material comprising:

a multi-phase composite material that includes a matrix component and a separate dispersed component embedded in the matrix component, the matrix component is a precious-metal based alloy that includes a precious metal as the single largest constituent of the matrix component, a transition metal as the second largest constituent of the matrix component, and a rare earth metal as the third largest constituent of the matrix component, and the dispersed component includes at least one of carbides, nitrides, or intermetallics.

15. A spark plug, comprising:

a metallic shell having an axial bore;

an insulator having an axial bore and being at least partially disposed within the axial bore of the metallic shell;

a center electrode being at least partially disposed within the axial bore of the insulator; and a ground electrode being attached to a free end of the metallic shell;

the center electrode, the ground electrode or both includes an electrode material that has a multi-phase composite material with a matrix component and a dispersed component, wherein the matrix component includes at least one precious metal and the dispersed component includes a carbide or a nitride that is embedded in the matrix component so that the matrix component and the dispersed component are separate materials that exhibit an interface or transitional boundary therebetween.

16. The spark plug of claim 15, wherein the dispersed component includes at least one carbide selected from the group consisting of: hafnium carbide (HfC), tungsten carbide (WC), zirconium carbide (ZrC), molybdenum carbide (MoC), chromium carbide ($Cr_3C_2$, $Cr_7C_3$, $Cr_{23}C_6$), niobium carbide (NbC), tantalum carbide (TaC), vanadium carbide (VC) or titanium carbide (TiC).

17. The spark plug of claim 15, wherein the dispersed component includes at least one nitride selected from the group consisting of: hafnium nitride (HfN), tungsten nitride (WN), zirconium nitride (ZrN), molybdenum nitride (MoN), chromium nitride (CrN), niobium nitride (NbN), tantalum nitride (TaN), vanadium nitride (VN), titanium nitride (TiN), titanium carbo-nitride (TiCN), titanium aluminum nitride (TiAlN) or titanium aluminum carbo-nitride (TiAlCN).

18. The spark plug of claim 15, wherein the matrix component includes platinum or a platinum alloy, at least one transition metal, and at least one rare earth metal, and the platinum or the platinum alloy is the single largest constituent of the matrix component.

19. The spark plug of claim 15, wherein the multi-phase composite material includes at least one of the following matrix component-dispersed component combinations, where the materials are given in weight percentage ranges and Pt constitutes the balance: Pt-(0.1-2.0)HfC, Pt-(0.1-2.0)WC, Pt-(0.1-2.0)NbC, Pt-(0.1-2.0)TaC, Pt-(0.1-2.0)HfN, Pt-(0.1-2.0)NbN, or Pt-(0.1-2.0)TaN.

* * * * *